US008006770B2

(12) United States Patent
Watson

(10) Patent No.: US 8,006,770 B2
(45) Date of Patent: Aug. 30, 2011

(54) EXPANDABLE CASING WITH ENHANCED COLLAPSE RESISTANCE AND SEALING CAPABILITY

(75) Inventor: Brock W. Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 223 days.

(21) Appl. No.: 12/371,741

(22) Filed: Feb. 16, 2009

(65) Prior Publication Data

US 2010/0206585 A1 Aug. 19, 2010

(51) Int. Cl.
*E21B 23/00* (2006.01)

(52) U.S. Cl. ..... 166/380; 166/207; 166/382

(58) Field of Classification Search ..... 166/227, 166/206, 207, 381, 382, 384, 380
See application file for complete search history.

(56) References Cited

U.S. PATENT DOCUMENTS 5,174,340 A 12/1992 Peterson et al.
5,275,240 A 1/1994 Peterson et al.
7,225,868 B2 6/2007 Arai
2004/0040723 A1 * 3/2004 Hovem ..... 166/384
2005/0121204 A1 6/2005 Vloedman et al.
2005/0236159 A1 * 10/2005 Costa et al. ..... 166/380
2006/0237188 A1 * 10/2006 McMahan ..... 166/207
2007/0132236 A1 6/2007 Dubedout
2009/0301733 A1 * 12/2009 Shuster et al. ..... 166/378

FOREIGN PATENT DOCUMENTS

WO 2005021922 A2 3/2005

OTHER PUBLICATIONS

International Search Report with Written Opinion issued Sep. 30, 2010, for International Patent Application No. PCT/US10/024034, 8 pages.

* cited by examiner

*Primary Examiner* — Hoang Dang
(74) *Attorney, Agent, or Firm* — Marlin R. Smith

(57) ABSTRACT

An expandable casing with enhanced collapse resistance and sealing capability. An expandable tubular for use in a subterranean well includes multiple recesses extending into a wall of the tubular, with the recesses being longitudinally spaced apart along the wall. A method of expanding tubulars in a subterranean well includes the steps of: expanding a tubular in the well, the tubular including multiple recesses extending into a wall of the tubular; and after the expanding step, allowing the wall of the tubular to retract radially inward more at each of the recesses than between the recesses.

20 Claims, 3 Drawing Sheets

EXPANDABLE CASING WITH ENHANCED COLLAPSE RESISTANCE AND SEALING CAPABILITY

BACKGROUND

The present disclosure relates generally to equipment utilized and operations performed in conjunction with a subterranean well and, in an embodiment described herein, more particularly provides an expandable casing with enhanced collapse resistance and sealing capability.

It is now common practice to expand casing downhole. However, one major problem with current expandable casing is that its collapse resistance after expansion is typically much less than desired. One reason for this low collapse resistance is that the casing must have a relatively thin wall thickness due to expansion force and pressure limitations of the expansion tool used to expand the casing.

Another problem with current expandable casings is that, after one casing is expanded within another casing, the inner casing will spring back radially more than the outer casing due to the higher strains applied to the inner casing in the expansion process. This situation means that a gap results between the inner and outer casings, making it more difficult to obtain a seal between the casings.

Therefore, it will be appreciated that advancements are needed in the art of expanding casing downhole.

SUMMARY

In the present specification, expandable casings are provided which solve at least one problem in the art. One example is described below in which the casing has one or more internal or external grooves formed thereon to enhance collapse resistance. Another example is described below in which an outer casing has the grooves formed thereon to thereby reduce or eliminate a gap between the outer casing and an inner casing.

In one aspect, an expandable tubular for use in a subterranean well is provided by this disclosure. The expandable tubular includes multiple recesses extending into a wall of the tubular. The recesses are longitudinally spaced apart along the wall.

In another aspect, a method of expanding tubulars in a subterranean well is provided by this disclosure. The method includes the steps of: expanding a tubular in the well, with the tubular including multiple recesses extending into a wall of the tubular. After the expanding step, the wall of the tubular is allowed to retract radially inward more at each of the recesses than between the recesses.

The method can include expanding another tubular within the first tubular. After expansion, a clearance between the tubulars is less at each of the recesses than between the recesses. Preferably, the tubulars are in contact at each of the recesses.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
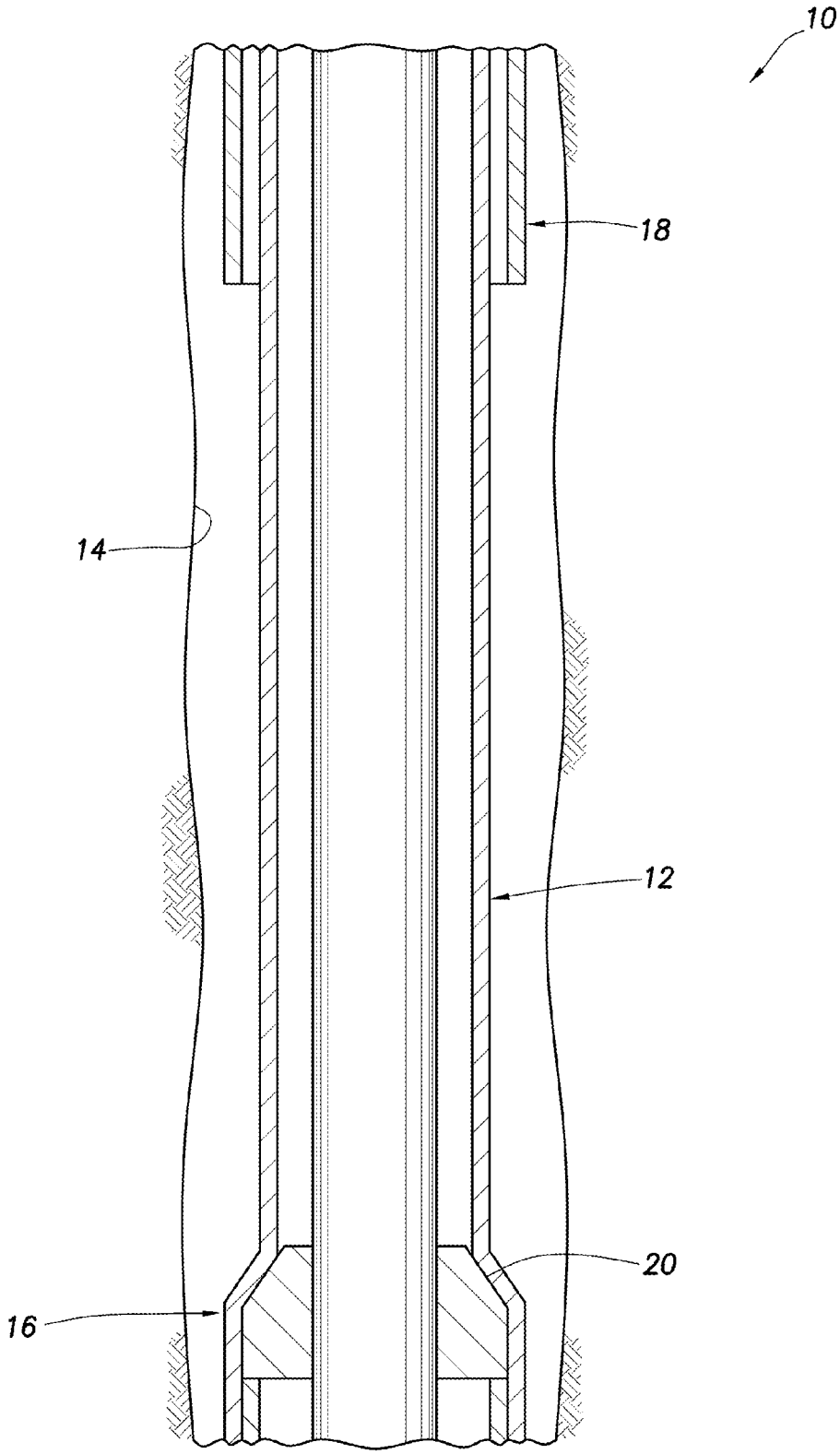
FIG. 1 is a schematic partially cross-sectional view of a well system embodying principles of the present disclosure.

Representatively illustrated in FIG. 1 is a well system 10 which embodies principles of the present disclosure. In the system 10, a tubular 12 is positioned in a wellbore 14 and is expanded radially outward using an expansion tool 16. Another tubular 18 is also expanded radially outward by the expansion tool 16, at least in an area where the tubulars 12, 18 overlap.

As depicted in FIG. 1, the tubulars 12, 18 are casings or liners used to form a protective lining within the wellbore 14. As used herein, the term "casing" is used to indicate any tubular protective lining for a wellbore, and can include tubulars known to those skilled in the art as casing, liner, tubing, pipe, etc., whether or not perforated or equipped with well tools such as screens, flow control devices, etc. Casing can be made of any material (such as metal, composites, etc.), can be segmented or continuous, and can be formed in situ.

However, it should be clearly understood that any other type of tubular can be used in keeping with the principles of this disclosure. For example, the tubular 12 could comprise a well screen, a flow control device, any other type of well tool, a tubing (such as production or injection tubing), etc.

The expansion tool 16 as illustrated in FIG. 1 includes an expansion device 20 in the form of a cone which is driven longitudinally through the interior of the tubular 12 in order to radially outwardly expand the tubular. Other types of expansion devices (such as rollers, inflatable bladders, segmented swages, etc.) may be used for expanding the tubulars 12, 18 in keeping with the principles of this disclosure.

As depicted in FIG. 1, the expansion device 20 displaces upwardly through the interior of the tubulars 12, 18 to expand the tubulars. However, the expansion process could proceed in a downward or any other direction, if desired. Note, also, that the outer tubular 18 could be expanded prior to expanding the inner tubular 12.

In the system 10, the tubulars 12, 18 are uniquely configured to overcome shortcomings of prior expandable tubulars and methods of expanding tubulars downhole. Examples of unique configurations of the tubulars 12, 18 are described more fully below, but at this point it should be emphasized that the principles of this disclosure are not limited to any of the details described herein for the system 10 and the examples of the tubulars 12, 18. Instead, the principles of this disclosure are applicable to a wide variety of different systems, tubulars and methods.

Figure 2:
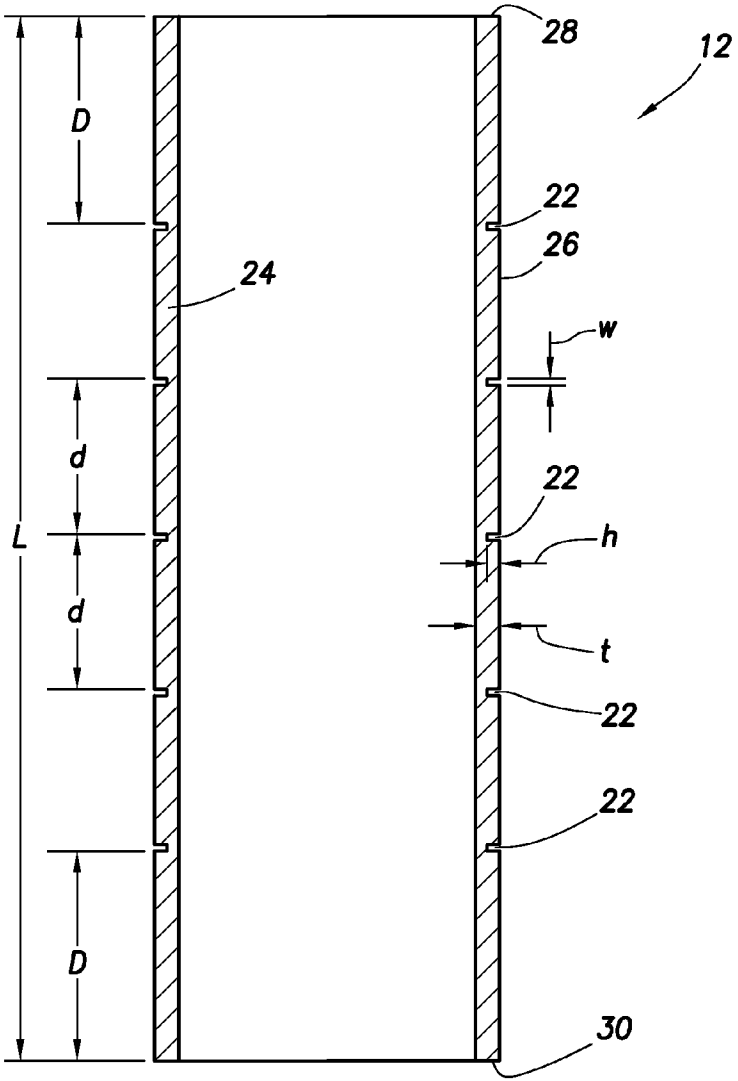
FIG. 2 is an enlarged scale schematic cross-sectional view of a casing configuration which may be used in the well system of FIG. 1, and which embodies principles of this disclosure.

Referring additionally now to FIG. 2, an enlarged scale cross-sectional view of the tubular 12 is representatively illustrated. The tubular 12 as depicted in FIG. 12 has a relatively short overall length L for illustration purposes, but in actual practice the tubular could be many meters in length.

A series of longitudinally spaced apart recesses 22 extend inwardly into a wall 24 of the tubular 12 from an outer surface 26 of the tubular. As depicted in FIG. 2, the recesses 22 are each in the form of a circumferential groove which extends approximately halfway through the wall 24, thereby reducing a nominal thickness t of the wall by about half. Thus, a depth h of each recess 22 is preferably, but not necessarily, equal to half of the wall thickness t. A longitudinal width w of each recess 22 is preferably, but not necessarily, less than its depth h.

The recesses 22 are preferably evenly spaced apart along the wall 24 by a distance d which is less than a distance D between the longitudinally outermost recesses and opposite ends 28, 30. At least some of the recesses 22 are positioned more than one-fourth of the tubular overall length L away from the opposite ends 28, 30.

In any event, a substantial majority of the length L of the tubular 12 has the spaced apart recesses 22 formed thereon, even though there may be no recesses within the length D from each of the opposite ends 28, 30. Preferably, between the longitudinally outermost ones of the recesses 22, no substantial length of the tubular 12 is without one of the recesses thereon.

The recesses 22 as depicted in FIG. 2 extend circumferentially about the wall 24, and the recesses are spaced apart from each other. However, the recesses 22 could instead be portions of one or more grooves extending helically along the wall 24. In addition, the recesses 22 could be either externally or internally formed on the wall 24.

Figure 3:
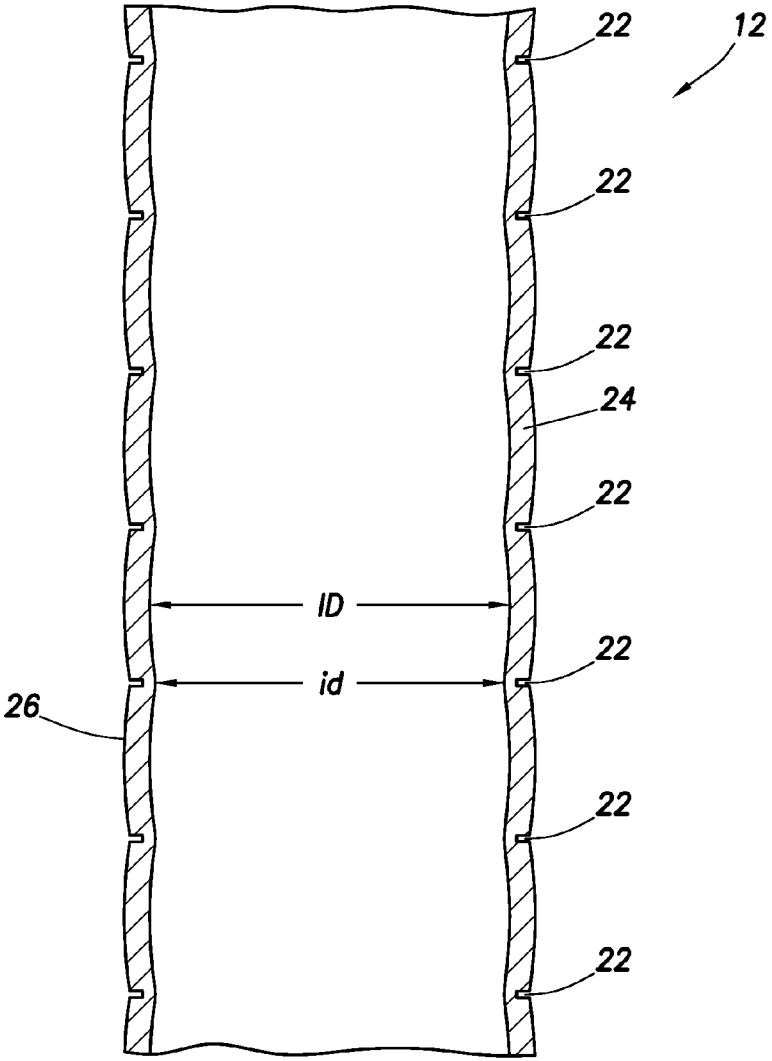
FIG. 3 is a schematic cross-sectional view of the casing of FIG. 2 after expansion of the casing.

Referring additionally now to FIG. 3, the tubular 12 is representatively illustrated after having been expanded, for example, using the expansion tool 16 in the system 10. Note that an internal diameter id of the tubular 12 at the recesses 22 is less than an internal diameter ID between the recesses.

This is due to the greater strain induced in the wall 24 at the recesses 22 as compared to between the recesses during the expansion process. After the tubular 12 has been expanded, the wall 24 retracts radially inward more at the recesses 22 than between the recesses.

As result, the tubular 12 has a somewhat "corrugated" configuration after the expansion process. This configuration imparts greater collapse resistance to the tubular 12 but, due to the relatively small size of the recesses 22, the presence of the recesses does not significantly affect the Lame' burst or collapse resistance of the tubular 12.

Figure 4:
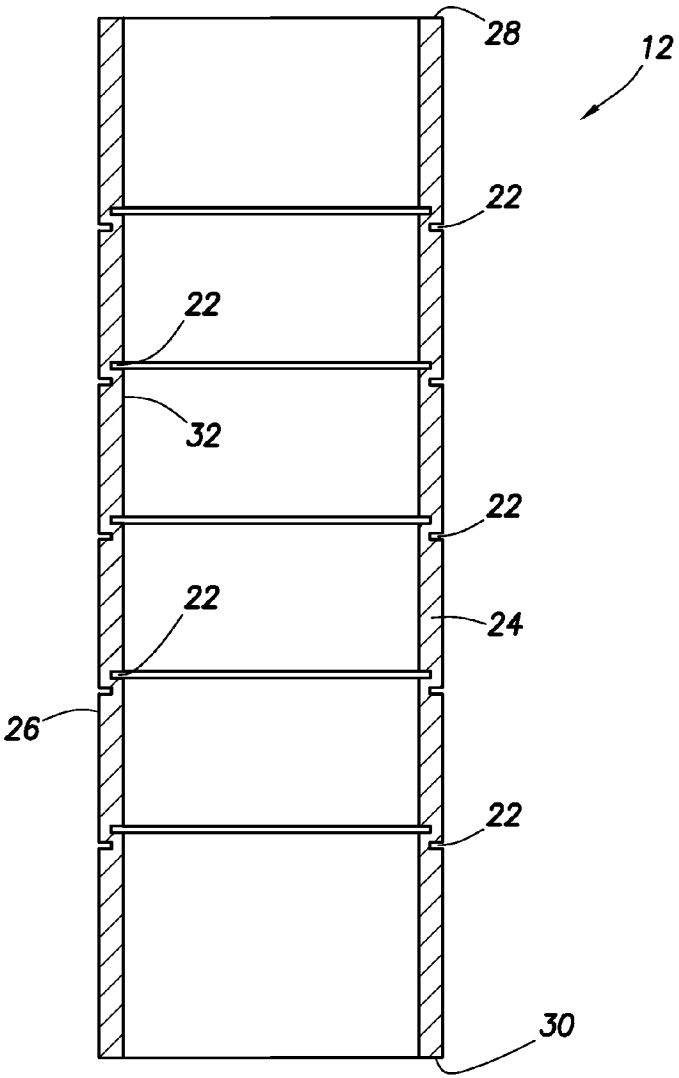
FIG. 4 is a schematic cross-sectional view of another configuration of the casing.

Referring additionally now to FIG. 4, another configuration of the tubular 12 is representatively illustrated in which the recesses 22 are formed both internally and externally on the wall 24 of the tubular. The addition of the internal recesses 22 may enhance the corrugation effect depicted in FIG. 3 (i.e., producing a greater difference between the inner diameters id and ID after expansion).

The internal recesses 22 may have dimensions similar to the external recesses, and may have similar dimensional relationships relative to the thickness t of the wall 24. As an alternative, the internal recesses 22 could be positioned in different portions of the tubular 12 from the external recesses, or the internal recesses could be used without the external recesses.

The internal recesses 22 are preferably in close proximity to the external recesses for enhancement of the corrugation effect (e.g., with each internal recess being less than one-half d spaced away from the next adjacent external recess). Other spacings of the internal and external recesses 22 may be used, if desired.

Figure 5:
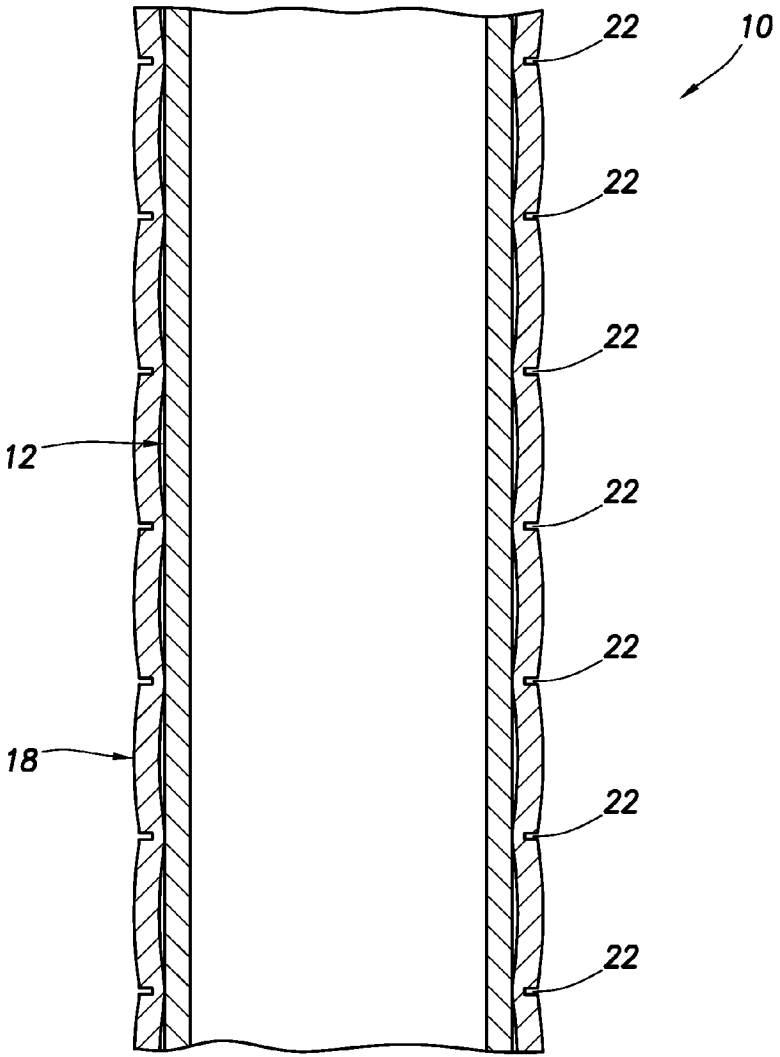
FIG. 5 is a schematic cross-sectional view of the casing of FIG. 2 expanded with another casing therein.

Referring additionally now to FIG. 5, overlapping portions of the tubulars 12, 18 are representatively illustrated after the tubulars have been expanded in the system 10 of FIG. 1. Note that the outer tubular 18 has the recesses 22 formed on an exterior thereof, and that the outer tubular contacts the inner tubular 12 at each recess along the lengths of the tubulars.

Thus, the presence of the recesses 22 reduces (and in this example eliminates) the radial clearance between the tubulars 12, 18 at each of the recesses, thereby enhancing sealing between the tubulars. However, some radial clearance between the tubulars 12, 18 remains in the areas longitudinally between the recesses 22.

Although the inner tubular 12 is not depicted in FIG. 5 as having any recesses formed thereon where the tubulars 12, 18 overlap, recesses could be provided at this portion of the inner tubular, if desired. In addition, although only external recesses 22 are depicted on the outer tubular 18 in FIG. 5, internal recesses could be provided also or as an alternative, if desired. Note that there are preferably no threads on either of the tubulars 12, 18 in the area where they overlap.

The inner tubular 12 could be expanded within the outer tubular 18 after, and/or at the same time as, the 5 outer tubular is expanded. For example, the expansion tool 16 could be used to expand the tubulars 12, 18 simultaneously where the tubulars overlap, and/or the outer tubular could have previously been expanded prior to the inner tubular being expanded therein.

The outer tubular 18 may include any, all, or any combination of, the features described above for the inner tubular 12. The positions of the tubulars 12, 18 could be reversed, if desired (i.e., the tubular 18 could be expanded within the tubular 12).

It may now be fully appreciated that this disclosure provides significant advancements to the art of expanding tubulars in subterranean wells. For example, in the described examples, the tubulars 12, 18 are provided with enhanced collapse resistance, and sealing between the tubulars is also enhanced.

The above disclosure describes an expandable tubular 12 for use in a subterranean well, with the expandable tubular 12 including multiple recesses 22 extending into a wall 24 of the tubular 12. The recesses 22 are longitudinally spaced apart along the wall 24.

Each of the recesses 22 may extend into the wall 24 approximately half of a nominal thickness t of the wall 24. Each of the recesses 22 may reduce a thickness t of the wall 24 by approximately half at the recess 22.

The recesses 22 may be positioned away from opposite ends 28, 30 of the tubular 12 by a distance greater than one-fourth of an overall length L of the tubular 12.

The recesses 22 may be spaced apart along a majority of an overall length L of the tubular 12. The recesses 22 may be substantially evenly spaced apart along a majority of the overall length L of the tubular 12.

A width w of each recess 22 may be less than a depth h of the recess 22 into the wall 24 of the tubular 12.

Preferably, between longitudinally outermost ones of the recesses 22, no substantial length of the tubular 12 is without one of the recesses 22 thereon.

An inner diameter id of the tubular 12 at each recess 22 may be less than an inner diameter ID of the tubular 12 between the recesses 22.

The recesses 22 may be externally formed on the tubular 12. Alternatively, or in addition, the recesses 22 may be internally formed on the tubular 12.

The above disclosure also describes a method of expanding tubulars 12, 18 in a subterranean well, with the method including the steps of: expanding a tubular 18 in the well, the tubular 18 including multiple recesses 22 extending into a wall 24 of the tubular 18; and after the expanding step, allowing the wall 24 of the tubular 18 to retract radially inward more at each of the recesses 22 than between the recesses 22.

The method may also include the step of expanding a second tubular 12 within the first tubular 18. The step of allowing the wall 24 of the first tubular 18 to retract radially inward more at each of the recesses 22 than between the recesses 22 may include a clearance between the first and second tubulars 18, 12 being less at each of the recesses 22 than between the recesses 22.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. An expandable tubular for use in a subterranean well, the expandable tubular comprising:

multiple recesses extending into a wall of the tubular, and the recesses being longitudinally spaced apart along the wall, wherein an inner diameter of the tubular at each recess is less than an inner diameter of the tubular between the recesses.

2. The expandable tubular of claim 1, wherein each of the recesses extends into the wall approximately half of a nominal thickness of the wall.

3. The expandable tubular of claim 1, wherein each of the recesses reduces a thickness of the wall by approximately half at the recess.

4. The expandable tubular of claim 1, wherein the recesses are positioned away from opposite ends of the tubular by a distance greater than one-fourth of an overall length of the tubular.

5. The expandable tubular of claim 1, wherein the recesses are spaced apart along a majority of an overall length of the tubular.

6. The expandable tubular of claim 5, wherein the recesses are substantially evenly spaced apart along a majority of the overall length of the tubular.

7. The expandable tubular of claim 1, wherein a width of each recess is less than a depth of the recess into the wall of the tubular.

8. The expandable tubular of claim 1, wherein, between longitudinally outermost ones of the recesses, no substantial length of the tubular is without one of the recesses thereon.

9. The expandable tubular of claim 1, wherein the recesses are externally formed on the tubular.

10. A method of expanding tubulars in a subterranean well, the method comprising the steps of:

expanding a first tubular in the well, the first tubular including multiple recesses extending into a wall of the first tubular; and after the expanding step, allowing the wall of the first tubular to retract radially inward more at each of the recesses than between the recesses.

11. The method of claim 10, further comprising the step of expanding a second tubular within the first tubular, and wherein the step of allowing the wall of the first tubular to retract radially inward more at each of the recesses than between the recesses further comprises a clearance between the first and second tubulars being less at each of the recesses than between the recesses.

12. The method of claim 10, wherein each of the recesses extends into the wall approximately half of a nominal thickness of the wall in the expanding step.

13. The method of claim 10, wherein a thickness of the wall is reduced by approximately half at the recess in the expanding step.

14. The method of claim 10, wherein the recesses are positioned away from opposite ends of the first tubular by a distance of greater than one-fourth of an overall length of the first tubular in the expanding step.

15. The method of claim 10, wherein the recesses are spaced apart along a majority of an overall length of the first tubular in the expanding step.

16. The method of claim 15, wherein the recesses are substantially evenly spaced apart along a majority of the overall length of the first tubular in the expanding step.

17. The method of claim 10, wherein a width of each recess is less than a depth of the recess into the wall of the first tubular in the expanding step.

18. The method of claim 10, wherein, between longitudinally outermost ones of the recesses, no substantial length of the first tubular is without one of the recesses thereon in the expanding step.

19. The method of claim 10, wherein an inner diameter of the first tubular at each recess is less than an inner diameter of the first tubular between the recesses after the expanding step.

20. The method of claim 10, wherein the recesses are externally formed on the first tubular in the expanding step.

* * * * *